United States Patent [19]

Weill et al.

[11] 4,047,988

[45] Sept. 13, 1977

[54] LIQUID MONOPROPELLANT COMPOSITIONS

[75] Inventors: Paul B. Weill, Newport; Paul L. Darby, Middletown, both of R.I.

[73] Assignee: The United States of America as represented by the Secretary of the Navy, Washington, D.C.

[21] Appl. No.: 651,099

[22] Filed: June 29, 1967

[51] Int. Cl.[2] ..... C06B 47/04

[52] U.S. Cl. ..... 149/74; 149/46;76;47;62;78;92;105

[58] Field of Search ..... 149/46, 47, 61, 62, 149/74, 70, 75, 76, 78, 105, 83, 92

[56] References Cited

U.S. PATENT DOCUMENTS

| | | | |
|---|---|---|---|
| 2,947,618 | 8/1960 | Stengel et al. | 149/92 |
| 3,013,382 | 12/1961 | Doss | 149/92 X |
| 3,018,619 | 1/1962 | Doss et al. | 149/92 X |
| 3,031,839 | 5/1962 | Larson | 149/92 X |
| 3,058,301 | 10/1962 | Larsen et al. | 149/92 X |
| 3,088,272 | 5/1963 | Stengel et al. | 149/92 X |
| 3,115,005 | 12/1963 | Clark | 149/92 X |
| 3,125,852 | 3/1964 | Blackwell et al. | 149/92 X |
| 3,212,254 | 10/1965 | Fox | 149/92 X |

*Primary Examiner*—Stephen J. Lechert, Jr.
*Attorney, Agent, or Firm*—Richard S. Sciascia; Arthur A. McGill; Prithvi C. Lall

[57] ABSTRACT

A three component liquid monopropellant composition, adaptable for providing underwater propulsion which comprises an amine salt, oxidant and a desensitizing quantity of water sufficient to provide cooling and steam generation. A method for providing underwater propulsion wherein the aforesaid liquid monopropellant is combusted in the combustion chamber of an underwater reaction motor.

10 Claims, No Drawings

LIQUID MONOPROPELLANT COMPOSITIONS

BACKGROUND OF THE INVENTION

This invention relates to a novel propellant composition and more particularly to a novel liquid monopropellant composition suitable for rendering underwater propulsion. In a further aspect, this invention relates to a method for obtaining underwater propulsion whereby the novel liquid monopropellant of this invention is combusted in the chamber of an underwater reaction motor.

Propellant compositions may be generally classed according to their physical state, whether solid, liquid, or slurry, a hybrid of solid and liquid. Within these broader definitions, propellant compositions may be typified as being multipropellant or monopropellant, depending on whether the fuel and oxidant are stored and maintained separately until the moment of combustion or are combined in a single composition. In general, liquid monopropellants are considered the favored class of propulsion means since they are easier to load, require only one tank for storage, one pump, one nozzle, one fuel line and one set of controls, and further because variable thrust control in the liquid propellant is generally easier to obtain. Heretofore, however, no wholly satisfactory liquid monopropellant composition has been provided for underwater utility in such critical operations as torpedo propulsion and the like. Consequently, the prior art has been forced to rely on such lesser desirable compositions as the solid monopropellants or the solid or liquid multipropellants. Solid propellants are unsatisfactory for torpedo propulsion for several reasons: first, due to possible variances in burning area resulting from uneven erosion and cracking, combustion of the solid propellant is of an unacceptably unsteady rate; second, since combustion of solid propellants generally result in the formation of a high percentage of non-condensible exhaust gases, underwater vehicles propelled by solid propellants are often characterized by severe wake formation in shallow waters; and finally, since both thrust and combustion in solid propellants are pressure dependent, propulsion of the underwater vehicle is highly sensitive to slight vehicle depth variations.

Liquid multipropellant systems are equally unsatisfactory for underwater propulsion principally since they require extensive ullage space and oxygen venting which preclude sealed cartridge loading, and require separate transfer and metering mechanisms for fuel and oxidant wherein high potential hazards of accidental mixing exists.

SUMMARY OF THE INVENTION

Accordingly, it is an object of this invention to provide a family of medium energy propellants suitable for propulsion of underwater vehicles, capable of fulfilling tactical exigencies of variable speed, variable running depth and wakelessness in shallow waters. It is further an object of this invention to provide an underwater propellant composition which may be safely prepared, handled and stored and which may be readily loaded in sealed cartridge form. Further, it is an object of this invention to provide a method for obtaining underwater propulsion whereby a liquid monopropellant is combusted in the combustion chamber of underwater vehicle.

These and other objects are attained by providing a liquid monopropellant comprising an aqueous solution of an amine salt of an oxidizing acid, and a water soluble oxidant.

DESCRIPTION OF THE PREFERRED EMBODIMENTS

The liquid monopropellant composition of this invention is prepared by mixing a secondary or tertiary amine with an oxidizing acid such as perchloric or nitric acid. The preferred amines of this invention include the heterocyclic amines such as the $\alpha$, $\beta$, or $\gamma$ picolines, alkoxypyridine, hydroxypyridine, the halogenatedpyridines such as 2-chloropyridine, nitropyridine, quinoline, acridine, polypyridine and the like. The particular amine selected is not critical and any tertiary or secondary amine may be used herein provided (1) its salts with oxidizing acids are stable in aqueous acid solutions and are resistant to oxidizing environments and (2) its salts in aqueous solutions with complementary oxidizers do not undergo solid or vapor phase separation within the operating temperature range.

Although the oxidizing acids used in this invention to form the amine salts may be either nitric or perchloric acid, the latter is preferred since its combustion products are soluble or condensable gases.

The operable oxidizers of this invention may be any of the common water soluble oxidants, such as hydrogen peroxide, ammonium nitrate, ammonium perchlorate, nitric acid, perchloric acid, the corresponding alkali metal salts of nitric and perchloric acids and mixtures thereof. Preferred for maximum compatibility is perchloric acid in combination with its respective amine salts.

Critical to this invention is the use of a proper quantity of water for purposes of providing cooling, steam generation and desensitization. If insufficient water is used, the sensitivity of the composition will be substantially increased tending to approach the point of unacceptability from the standpoint military requirements and safety. Further, the proper quantity of water is critical for controlling the temperature of combustion which in turn directly affects the formation of the highly condensible and soluble combustion products critical for permitting the use of the composition in wakeless underwater power plant operations. It has been experimentally determined that a corrolation exists between "excess energy" and the sensitivity of the system, which relationship can be used to advantage in determining the critical minimum quantity of water which must be present. The excess energy is herein defined as the difference between the heat of formation combined with the heat of solution of the reactants and the heat of formation of the combustion products. For systems containing nitric acid amine salts, it has been experimentally found that acceptable sensitivity exists when the critical excess energy is less than 900 calories per gram of propellant and for systems containing perchloric acid amine salts, acceptable sensitivity exists when the excess energy is less then about 700 calories per gram. By increasing the quantity of water, the heat of formation of the reactants increases consequently decreasing both the excess energy and the sensitivity of the composition. In general, the minimum quantity of water required for nitric acid amine salt containing compositions is about 20% based on the weight of the total composition while the minimum quantity of water required for perchloric acid amine salt containing compositions is about 35% based on the weight of total composition. The maximum quantity of water is not critical and can quickly be determined by one of ordinary skill in the art. Normally, however, no more than 65% water based on the weight of the composition is desirable.

The general procedure for preparing the monopropellants of this invention comprises (a) preparing an amine salt by neutralizing the selected amine with an oxidizing acid while stirring and cooling to maintain approximately room temperature, (b) admixing a complementary oxidizer with the so formed amine salt and (c) forming a solution of the admixture of (b) with the required amount of water. The optimum quantity of oxidant depends in each instance on the type of amine salt and oxidizer selected. Although the precise amount of oxidant is not critical and the optimum can easily be determined by one of ordinary skill in the art, preferably, sufficient oxidant should be used to insure complete amine salt combustion. In general, the optimum weight ratio of salt to water soluble oxidant falls within the range of 1:1 to 1:10 and more preferably 1:1 to 1:8.

The monopropellants of this invention are liquid within the temperature range of −25° C to 75° C without undesirable solid separation or excessive vapor pressure. They are fully miscible with water in any proportion yet are non-hygroscopic. They are inflamable in bulk, safe, non-toxic by inhalation or contact, relatively insensitive to impact, adiabatic compression, shock wave initiation and heat. Since the vapor pressures of the compositions are relatively low, venting is not required and cartridge loading is possible. Ignition of the composition is attained by any conventional means such as pyrotechnic ignition. Combustion is steady and can be readily controlled by varying slightly the quantity of water above the minimum. The rate of combustion may be progressively varied thereby allowing throttling without the creation of undue pressure oscillations. Efficiency of combustion is high, about 96%, and the products of combustion are over 80% by volume gaseous containing no systemic poisonous components. Furthermore, the products of combustion are condensible or water soluble hence free exhaust to surrounding water is possible without undue back pressure or wake formation.

While storage container materials may be selected from any of the impervious polymers such as polyalkanes, Kel-F and Teflon, or compatible steels, a concentration of nitrate ions of 1% or more has been found to be especially effective in preventing stainless steel corrosion by the perchloric acid oxidizer containing propellants.

The present invention having been generally described above may be more fully understood by reference to the following examples which are presented herein for purposes of illustration only and are not intended to be limiting in any manner.

EXAMPLE I

A fraction of approximately 2% of a known amount of purified technical β-picoline is neutralized with a 70% aqueous solution of nitric acid. A 60% aqueous purified perchloric acid solution is then added under stirring and cooling, its temperature not being allowed to exceed 30° C. Final water content adjustment is made for obtaining the propellant composition:

| | Moles | Grams |
|---|---|---|
| β-picoline | 1.0 | 93.1 |
| Nitric acid ($HNO_3$) | 0.131 | 8.2 |
| Perchloric acid ($HClO_4$) | 3.793 | 382.0 |
| Water | 19.61 | 353.0 |
| | | 836.3 |

The fuel and oxidizer components of this propellant are in the proper ratio to insure complete combustion into $H_2O$, $CO_2$, HCl and $N_2$, with less than 1.5% by volume of other gases. The excess energy is 615 calories/gm of propellant.

EXAMPLE II

The presence of nitric ions in the propellant composition of Example I is optional, and only desirable when it is expected to be in prolonged contact with stainless steel. If the $NO_3^-$ additive is omitted, an equivalent amount of perchloric acid is used in place of nitric acid.

| | Moles | | Grams |
|---|---|---|---|
| β-picoline | 1.0 | | 93.1 |
| $HClO_4$ | 3.875 | | 389.4 |
| $H_2O$ | 19.96 | | 357.5 |
| | | Total | 839.0 |

The composition has the following physical properties

1. Freezing temperature (below −30° C) with supercooling.
2. Melting temperature −27° to −28° C.
3. Specific gravity: 1.350 at 25° C.
4. Vapor pressure: 11.2 mm Hg at 23° C.
5. Vapor composition at 25° C., virtually 100% water.
6. Boiling temperature (initial): 124° C.

Safety characterisitics of the above propellant:

Sensitivity to impact $E_{50}$= 110 - 115 kg-cm., conducted in accordance with JANAF Test #5.

Card gap: 0 cards at 20° C, 0 cards at 50° C; JANAF Test #1.

Thermal stability — no incipient degradation at 50° C for at least 1 month.

Storage stability — no evidence of any decomposition for at least 18 months (in glass).

7. Excess Energy: 620 calories/gm

This propellant, sprayed into a pre-pressurized (800–1200 p.s.i.) combustion chamber of about 1500 inch L*, ignites and sustains combustion for periods exceeding 75 seconds. Recorded combustion temperature and pressure are steady. Flow rate changes can be made without burn out, or rough transition.

This propellant produces gaseous exhaust with the analyzed composition, versus theoretical as shown below:

| | Theory | Found |
|---|---|---|
| $CO_2$ | 17.8 | 16.0 |
| $N_2$ | 1.5 | 2.8 |
| HCl | 11.5 | 11.1 |
| $H_2O$ | 69.5 | 67.5 |
| $H_2$ | 0.0 | 1.3 |
| CO | 0.0 | 1.2 |

Combustion efficiency of this propellant, in terms of oxidation of carbon atoms in the fuel component is thus calculated to be above 96%.

Percentage of solubles (water and hydrogen chloride) is seen to be at least 80 volume %. This value is considered by experts in the field to be near the minimal requirement to insure virtual wakelessness of exhaust from an underwater vehicle.

The card gap test indicated above is JANAF Test #1 is a measure of the hydrodynamic shock required to produce a stable propagation of a high order detonation in a standard steel cup filled with the liquid under evaluation. Sensitivity is expressed as the number of standard plastic cards which must be inserted between a 50 gram tetryl booster and the bottom of the test cup.

The drop weight test indicated above as JANAF Test #5 comprises inclosing a 0.03 ml sample in a 0.06 ml cavity formed by a steel cup and elastic O-ring and a steel diaphragm. A piston rests on the diaphragm and carries a vent hole which is blocked by the diaphragm. A 2 kg weight is dropped onto the piston. The sensitivity value is expressed by the number of kg-cm required to obtain a 50% explosion probability.

As will be evident to those skilled in the art, various modifications can be made or followed in the light of the foregoing disclosure and discussion without departing from the spirit or scope of the disclosure or from the scope of the claims.

What is claimed as new and desired to be secured by Letters Patent of the United States is:

1. A liquid monopropellant adaptable for underwater propulsion which consists of an aqueous solution comprising;

a. a secondary or tertiary amine salt of an oxidizing acid selected from the group consisting of perchloric acid and nitric acid b. a water soluble oxidant, and c. water present in an amount of at least 20% by weight of total composition when the amine salt is a nitric acid amine salt, and present in an amount of at least 35% by weight of total composition when the amine salt is a perchloric acid amine salt.

2. The liquid monopropellant of claim 1 wherein the quantity of water selected is sufficient to limit the standard heat of combustion of the monopropellant to a maximum of substantially 900 calories per gram when the amine salt is a nitric acid amine salt and substantially 700 calories per gram when the amine salt is a perchloric acid amine salt.

3. The liquid monopropellant of claim 1 wherein the amine salt is a perchloric acid salt of a tertiary amine.

4. The liquid monopropellant of claim 3 wherein the amine salt is a perchloric acid amine salt of a heterocyclic amine selected from the group consisting of picoline, alkoxypyridine, hydroxypyridine, halogenated-pyridine, nitropyridine, quinoline, acridine and polypyridine.

5. The liquid monopropellant of claim 4 wherein the amine salt is a perchloric acid salt of $\beta$-picoline.

6. The liquid monopropellant of claim 1 wherein the amine salt is a nitric acid salt of a heterocyclic amine selected from the group consisting of picoline, alkoxypyridine, halogenated pyridine, nitropyridine, quinoline, acridine and polypyridine.

7. The liquid monopropellant of claim 1 wherein the water soluble oxidant is selected from the group consisting of nitric acid, perchloric acid and the alkali metal salts thereof, hydrogen peroxide, ammonium nitrate, ammonium perchlorate and mixtures thereof.

8. The liquid monopropellant of claim 1 wherein the aqueous solution comprises an amine salt of perchloric acid, the water soluble oxidant is selected from the group consisting of perchloric acid, nitric acid and mixtures thereof and the quantity of water selected is sufficient to limit the standard heat of combustion of the monopropellant to a maximum of substantially 900 calories per gram when the amine salt is a nitric acid amine salt and substantially 700 calories per gram when the amine salt is a perchloric acid amine salt and wherein the weight ratio of the amine salt to the water soluble oxidant is in the range of 1:1 to 1:10.

9. The method of preparing and igniting underwater monopropellants susceptible of being combusted into gaseous products which comprises the steps of:

neutralizing a selected secondary or tertiary amine with an oxidizing acid from the group consisting of perchloric acid and nitric acid as a concentrated aqueous solution;

stirring and cooling during the neutralizing step to maintain substantially ambient temperature;

admixing a complementary water soluble oxidizer to allow for complete combustion;

adding sufficient water to provide adequate safety in handling and storage while controlling combustion temperature; and injecting the monopropellant into a preheated and pressurized combustion chamber.

10. The method of claim 9 wherein the selected amine is a perchloric acid salt of a tertiary amine and the complementary oxidizer is nitric acid.

* * * * *